US006398339B1

(12) United States Patent
Berg

(10) Patent No.: US 6,398,339 B1
(45) Date of Patent: Jun. 4, 2002

(54) TIME AND DRIVE SYSTEMS FOR A MULTIFUNCTION INK JET PRINTER MAINTENANCE STATION

(75) Inventor: Richard H. Berg, Rochester, NY (US)

(73) Assignee: Xerox Corp., Stamford, CT (US)

( * ) Notice: Subject to any disclaimer, the term of this patent is extended or adjusted under 35 U.S.C. 154(b) by 0 days.

(21) Appl. No.: 09/594,695

(22) Filed: Jun. 16, 2000

(51) Int. Cl.[7] ..... B41J 2/165
(52) U.S. Cl. ..... 347/32
(58) Field of Search ..... 347/22, 23, 24, 347/29, 30, 31, 32, 33; 74/567, 569

(56) References Cited

U.S. PATENT DOCUMENTS

| | | | | |
|---|---|---|---|---|
| 4,746,938 A | | 5/1988 | Yamamori et al. | 347/28 |
| 4,853,717 A | | 8/1989 | Harmon et al. | 347/29 |
| 4,855,764 A | | 8/1989 | Humbs et al. | 347/31 |
| 5,151,715 A | | 9/1992 | Ward et al. | 347/33 |
| 5,170,186 A | * | 12/1992 | Shimamura et al. | 347/23 |
| 5,250,962 A | | 10/1993 | Fisher et al. | 347/32 |
| 5,339,102 A | | 8/1994 | Carlotta | 347/32 |
| 5,434,605 A | * | 7/1995 | Osborne | 347/23 |
| 5,500,659 A | | 3/1996 | Curran, Jr. et al. | 347/28 |
| 5,548,310 A | | 8/1996 | Binnert et al. | 347/33 |
| 5,659,341 A | | 8/1997 | Kinas | 347/33 |
| 5,943,071 A | | 8/1999 | Premnath | 347/33 |
| 6,130,684 A | | 10/2000 | Premnath et al. | 347/30 |
| 6,132,027 A | * | 10/2000 | Suzuki et al. | 347/33 |
| 6,139,129 A | * | 10/2000 | Tabasso et al. | 347/33 |

FOREIGN PATENT DOCUMENTS

| | | | | |
|---|---|---|---|---|
| JP | 11192716 | * | 7/1999 | B41J/2/165 |

* cited by examiner

*Primary Examiner*—John Barlow
*Assistant Examiner*—Blaise Mouttet
(74) *Attorney, Agent, or Firm*—Oliff & Berridge, PLC

(57) ABSTRACT

A hardware solution functional including a shaft, an operational range of a full rotation in both directions, translatable force to a plurality of functions, and a translatable sequencing to the plurality of functions by the shaft.

21 Claims, 3 Drawing Sheets

TIME AND DRIVE SYSTEMS FOR A MULTIFUNCTION INK JET PRINTER MAINTENANCE STATION

BACKGROUND OF THE INVENTION

1. Field of Invention

This invention relates to maintenance stations for ink jet printing apparatus.

2. Description of Related Art

Ink jet printers have at least one printhead that directs droplets of ink towards a recording medium. Within the printhead, the ink may be contained in a plurality of channels. Energy pulses are used to expel the droplets of ink, as required, from orifices at the ends of the channels.

In a thermal ink jet printer, the energy pulses are usually produced by resistors. Each resistor is located in a respective one of the channels, and is individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink to form a droplet moving in a direction away from the channel and towards the recording medium. The channel is then re-filled by capillary action, which in turn draws ink from a supply container. Operation of a thermal ink jet printer is described in, for example, U.S. Pat. No. 4,849,774.

A carriage-type thermal ink jet printer is described in U.S. Pat. No. 4,638,337. That printer has a plurality of printheads, each with its own ink tank cartridge, mounted on a reciprocating carriage. The channel orifices in each printhead are aligned perpendicular to the line of movement of the carriage. A swath of information is printed on the stationary recording medium as the carriage is moved in one direction. The recording medium is then stepped, perpendicular to the line of carriage movement, by a distance equal to the width of the printed swath. The carriage is then moved in the reverse direction to print another swath of information.

The ink ejecting orifices of an ink jet printer need to be maintained, for example, by periodically cleaning the orifices when the printer is in use, and/or by capping the printhead when the printer is out of use or is idle for extended periods. Capping the printhead is intended to prevent the ink in the printhead from drying out. The cap provides a controlled environment to prevent ink exposed in the nozzles from drying out.

A printhead may also need to be primed before initial use, to ensure that the printhead channels are completely filled with the ink and contain no contaminants or air bubbles. After significant amounts of printing, and at the discretion of the user, an additional but reduced volume prime may be needed to clear particles or air bubbles which cause visual print defects. Maintenance and/or priming stations for the printheads of various types of ink jet printers are described in, for example, U.S. Pat. Nos. 4,364,065; 4,855,764; 4,853,717 and 4,746,938, while the removal of gas from the ink reservoir of a printhead during printing is described in U.S. Pat. No. 4,679,059.

The priming operation, which usually involves either forcing or drawing ink through the printhead, can leave drops of ink on the face of the printhead. As a result, ink residue builds up on the printhead face. This ink residue can have a deleterious effect on the print quality. Paper fibers and other foreign material can also collect on the printhead face while printing is in progress. Like the ink residue, this foreign material can also have deleterious effects on print quality.

The 717 patent discloses moving a printhead across a wiper blade at the end of a printing operation so that dust and other contaminants are scraped off the orifice before the printhead is capped, and capping the printhead nozzle by moving the printer carriage acting on a sled carrying the printhead cap. This eliminates the need for a separate actuating device for the cap. The 938 patent discloses providing an ink jet printer with a washing unit which, at the end of the printing operation, directs water at the face of the printhead to clean the printhead before it is capped.

SUMMARY OF THE INVENTION

This invention provides a cam-activated lever capping arm, a wiping mechanism and a pinch tube mechanism for a maintenance station for an ink jet printer.

In one exemplary embodiment of the maintenance station according to this invention, one or more printheads are mounted on a translatable carriage and moves with the carriage. When the printer is printing, the translatable carriage is located in a printing zone, where the one or more printheads can eject ink onto a recording medium. When the printer is placed into a non-printing mode, the translatable carriage is translated to the maintenance station located outside and to one side of the printing zone. Once the cartridge is translated to the maintenance station, various maintenance functions can be performed on the one or more printheads of the printer depending on the rotational position of a cam shaft in the maintenance station. The cam shaft engages and drives the hardware that in turn operates the individual maintenance functions.

Rotating the cam shaft activates various maintenance mechanisms of the maintenance station, including a wiper blade platform and a cap carriage. The wiper platform passes across the printhead nozzle faces when the one or more printheads enter the maintenance station and again just before the one or more printheads leave. A location for collecting ink cleared from the nozzles is placed adjacent to the wiper blades. After the one or more printheads arrive at the maintenance station, a vacuum pump is energized, and the cap carriage is elevated to the position where the one or more printhead caps engage the one or more printheads. The one or more printhead caps are mounted on the cap carriage in a capping location. The printheads are primed when a pinch tube mechanism opens one or more pinch tubes connected to the one or more printhead caps. Opening the pinch tubes releases negative pressure created by the vacuum pump. In response, ink is drawn from the one or more printheads into the one or more printhead caps.

Further moving the cam shaft lowers the cap carriage and enables the wiper blades to pass back across the nozzle faces to clean the ink jet printhead nozzles. The vacuum pump is then deenergized, while the cap carriage remains in position so that the one or more printhead caps cap the one or more printheads awaiting the printing mode of the printer. Thus, the one or more printheads remain capped at the maintenance station until the printer is into the printing mode.

The predetermined time that the printhead carriage is positioned adjacent to the maintenance station, including the gear and cam-actuated valve closing and the predetermined time that the printhead carriage is located relative to the capping platform, as controlled by the controller, determines pressure profiles and waste ink volumes. The controller enables a spectrum of waste ink volume and pressure profiles. One waste ink volume and pressure profile is appropriate for the initial installation of the cartridge, when the one or more capped printheads are kept a longer time at the capping location, to help ensure that all ink flow paths between the nozzles and supply cartridge are completely primed. A second waste ink volume and pressure profile is appropriate for a manual refresh prime. During such a manual refresh prime, the one or more capped printheads are kept at the capping location a relatively shorter time to prime only the one or more printheads.

These and other features and advantages of this invention are described in or are apparent from the detailed description of various exemplary embodiments of the systems and methods according to this invention.

BRIEF DESCRIPTION OF THE DRAWINGS

Various exemplary embodiments of this invention will be described in detail with reference to the following figures, wherein like numerals represent like elements, and wherein.

DETAILED DESCRIPTION OF EXEMPLARY EMBODIMENTS

Figure 1:
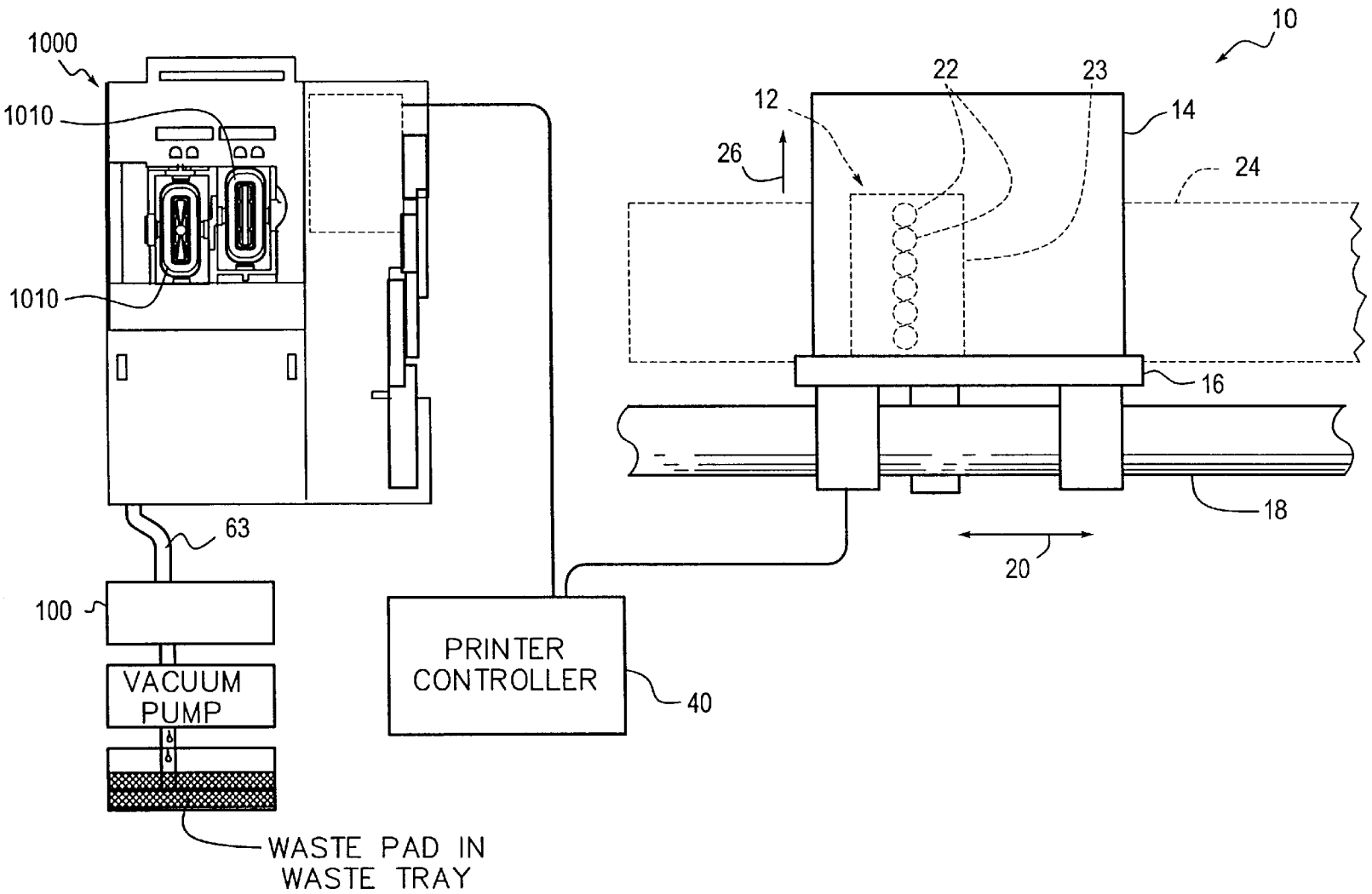
FIG. 1 is a schematic front elevation view of an ink jet printer and a maintenance station according to this invention.

FIG. 1 shows a printer 10, including one or more printheads 12, shown in dashed line, fixed to an ink supply cartridge 14. The ink supply cartridge 14 is removably mounted on a carriage 16. The carriage 16 is translatable back and forth on one or more guide rails 18 as indicated by the arrow 20, so that the one or more printheads 12 and the ink supply cartridge 14 move concurrently with the carriage 16. Each of the one or more printheads 12 contains a plurality of ink channels which terminate in nozzles 22 in a nozzle face 23 (both shown in dashed line). The ink channels carry ink from the ink supply cartridge 14 to the printhead nozzles 22.

When the printer 10 is in a printing mode, the carriage 16 translates or reciprocates back and forth across and parallel to a printing zone 24 (shown in dashed line). Ink droplets are selectively ejected on demand from the printhead nozzles 22 onto a recording medium, such as paper, positioned in the printing zone, to print information on the recording medium one swath or portion at a time. During each pass or translation in one direction of the carriage 16, the recording medium is stationary. At the end of each pass, the recording medium is stepped in the direction of the arrow 26 for the distance or the height of one printed swath. U.S. Pat. Nos. 4,571,599 and Re. 32,572, each incorporated herein by reference in its entirety, provide a more detailed explanation of the printhead and the printing operation.

When the printer 10 is no longer in a printing mode, the carriage 16 travels to a maintenance station 1000 spaced from the printing zone 24. With the one or more printheads 12 positioned at the maintenance station 1000, various maintenance functions can be performed on the one or more printheads 12.

Figure 2:
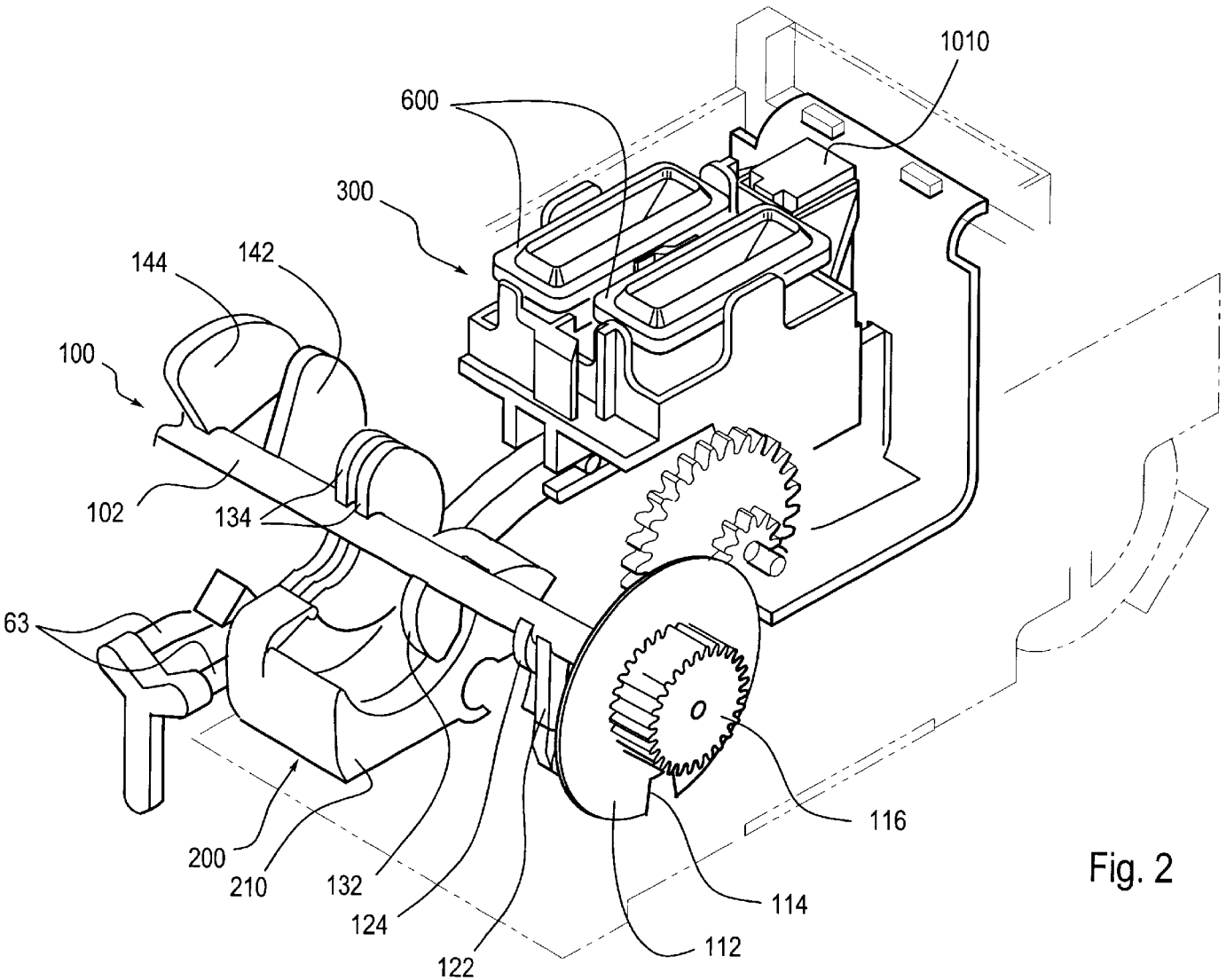
FIG. 2 is a top perspective view of the interior of a maintenance station of FIG. 1 according to this invention.

FIG. 2 is a top perspective view of the maintenance station 1000. As shown in FIG. 2, the maintenance station 1000 includes a cam shaft 100, a cam-actuated lever capping arm 200, and a cap carriage 300 mounted on a guide shaft 1010. In particular, as shown in FIG. 2 and more clearly seen in FIG. 3, the cam shaft 100 includes a unitary shaft member 102, a driving and control portion 110, a wiper blade drive portion 120, a cam-actuated lever capping arm drive portion 130 and a pinch tube actuating portion 140.

Figure 3:
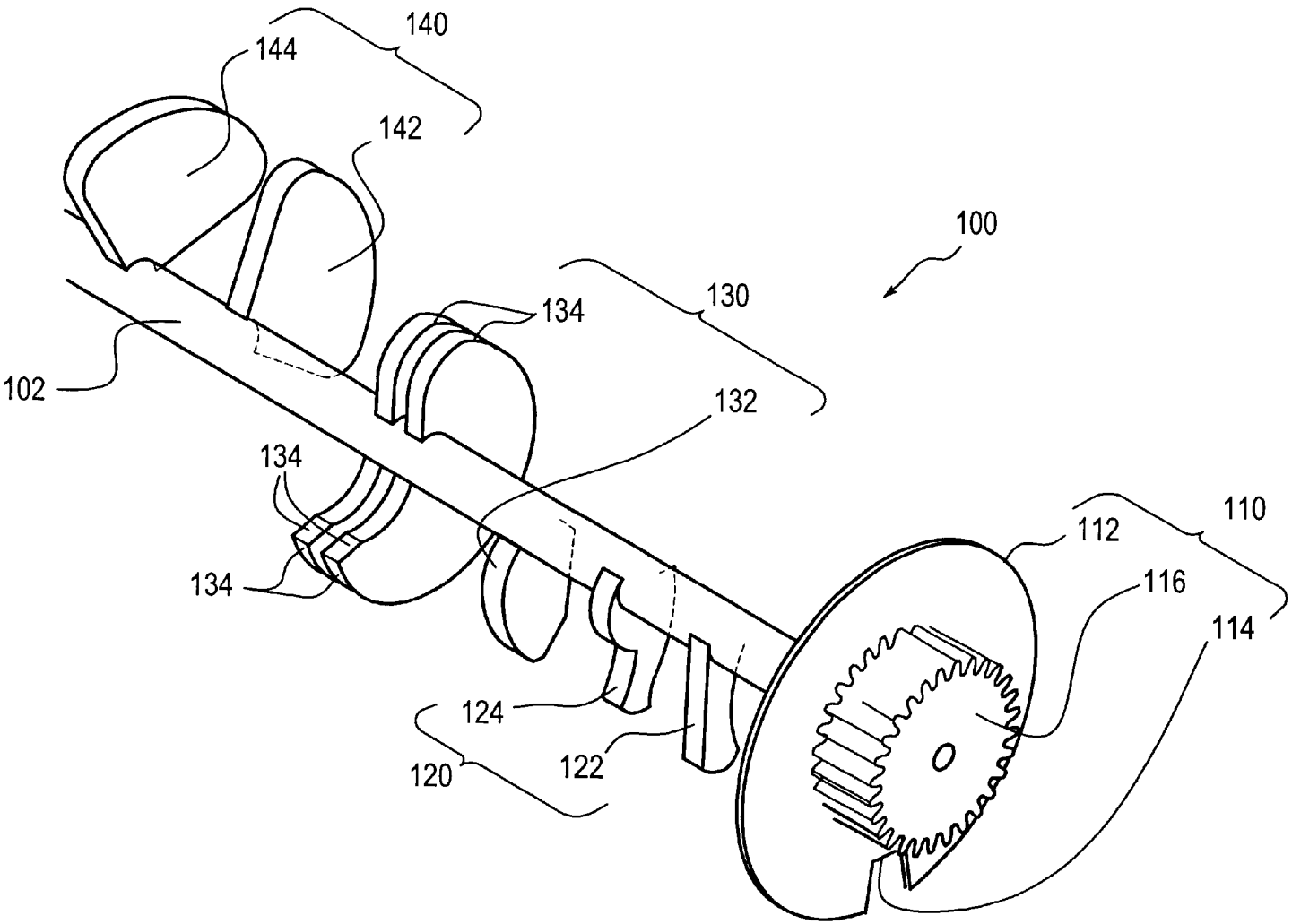
FIG. 3 is a partial perspective view of the cam shaft of FIG. 2.

In various exemplary embodiments, as shown in FIGS. 2 and 3, the driving and control portion 110 includes a sensor wheel 112, an optical window 114 formed in the sensor wheel 112, and a main drive gear 116. In operation, a drive gear train (not shown), comprising a drive motor connected to one or more drive gears, engages the main drive gear 116 to drive the cam shaft 100 in counterclockwise and then clockwise directions to actuate the various maintenance functions enabled by the maintenance station 1000. This is described in greater detail in copending U.S. patent application Ser. No. 09/594,694 filed herewith and incorporated herein by reference in its entirety.

In each of an extreme clockwise position of the cam shaft 100 and the extreme counterclockwise position of the cam shaft 100, the optical window 114 is aligned with an optical relay (not shown). Thus, after the drive gear train drives the main drive gear 116 to rotate the cam shaft 100 to the extreme clockwise or counterclockwise position, the optical window 114 formed in the sensor wheel 112 is aligned with the optical relay. In various exemplary embodiments, the optical relay includes a photo-emitter positioned on one side of the sensor wheel 112 and a photo-detector positioned on the other side of the sensor wheel 112. When the optical window 114 is not aligned with the optical relay, the optical relay is in an opened circuit condition.

At the start of a maintenance operation, the sensor wheel 112 is in the extreme clockwise position and the optical window 114 is aligned with the optical relay to close the circuit through the optical relay. As a result, when the one or more printheads 12 are aligned with the maintenance station 1000 and the main drive gear 116 is initially driven in the counterclockwise direction, the optical window 114 is no longer aligned with the optical relay and the optical relay is placed into an open circuit condition. Then, when the sensor wheel 112 reaches its extreme counterclockwise position, the window 114 is again aligned with the optical relay. As a result, the optical relay is placed in the closed circuit condition.

The open and closed circuit conditions of the optical relay are sensed by a printer controller 40, as shown in FIG. 1. In response, the printer controller 40 stops the gear train engaged with the main drive gear 116 from turning the cam shaft 100 for a predetermined time. In particular, this predetermined time depends on the priming mode currently selected for the maintenance station 1000.

Once the predetermined time has elapsed, the printer controller 40 starts the gear train to drive the main drive gear 116, and thus the cam shaft 100, in the clockwise direction. The cam shaft 100 continues rotating in the clockwise direction until the optical window 114 in the sensor wheel 112 is again aligned with the optical relay to again put the optical relay in a closed circuit condition. When the printer controller 40 again senses the closed circuit condition of the optical relay, the printer controller 40 again stops the gear train from driving the main drive gear 116, and thus the cam shaft 100, in the clockwise direction.

As shown in FIGS. 2 and 3, the various elements of the cam shaft drive portion 110, the wiper blade drive portion 120, the cam-actuated lever capping arm drive portion 130 and the pinch tube actuation portion 140 are mounted on a shaft 102 of the cam shaft 100. As shown in FIGS. 2 and 3, in various exemplary embodiments, the wiper blade drive portion 120 includes a forward wiper driving cam 122 that is used to drive the wiper blade platform from the first position to the second position, and a reverse wiper blade driving cam 124 that is used to drive the wiper blade platform from the second position back to the first position.

In the exemplary embodiments shown in FIGS. 2 and 3, the cam-actuated lever capping arm drive portion 130 includes a hold-down cam 132 and one or more capping cams 134. The structure and operation of the cam-actuated lever capping arm drive portion 130 and the cam-actuated lever capping arm 200 are described in greater detail in copending U.S. patent application Ser. No. 09/721,954 filed herewith and incorporated herein by reference in its entirety.

In particular, in various exemplary embodiments, when the cam shaft 100 first begins rotating in the counterclockwise direction, the wiper blade portion 120 drives a wiper blade platform (not shown) from a first position to a second position to wipe the nozzle faces 23 of the one or more printheads 12. Then, when the cam shaft 100 is driven in the clockwise direction, the wiper blade drive portion 120 of the cam shaft 100 lastly drives the wiper blade platform from the second position back to the first position to again wipe the nozzle face 23 of the one or more printheads 12 before the printhead 14 is moved from the maintenance station 1000 to the printer zone 24. The wiper blade platform, a wiper blade drive mechanism positioned between the cam shaft 100 and the wiper blade platform, and the operation of the wiper blade drive portion 120 is described in greater detail in the incorporated Ser. 09/594,694 application, and in U.S. patent application Ser. No. 09/594,681 filed herewith and incorporated herein by reference in its entirety.

In various exemplary embodiments, after the wiper blade drive portion 120 moves the wiper blade platform from the first position to the second position, the cam shaft 100 rotates further in the counterclockwise direction. As a result, the cam-actuated lever capping arm drive portion 130 interacts with a cam-actuated lever arm 200 to move a cap carriage 300 from a disengaged position to an engaged position. In the engaged position, one or more printhead caps 600 carried by the cap carriage 300 engage the one or more printheads 12 as the cam shaft 100 continues to rotate in the counterclockwise direction. Similarly, when the cam shaft 100 continues to rotate in the counterclockwise direction, the cam-actuated lever capping arm drive portion 130 interacts with the cam-actuated lever arm 200 to move the capping carriage 300 from the engaged position to the disengaged position, before the wiper blade drive portion 120 moves the wiper blade platform from the second position back to the first position. This is described in greater detail below. The structure and operation of the printhead caps 600 are described in greater detail in copending U.S. patent applications Ser. Nos. 09/594,682 and 09/594,691, each filed herewith and incorporated herein by reference in its entirety.

Likewise, after the cam-actuated lever capping arm drive portion 130 moves the capping station 300 from the disengaged position to the engaged position, the cam shaft 100 rotates further in the counterclockwise direction. As a result, the pinch tube actuating portion 140 actuates one or more pinch tubes 63 to apply a negative pressure to the one or more printheads cap 600 mounted on the cap carriage 300. The structure and operation of the pinch tubes 63 and the pinch tube mechanism is described in greater detail in copending U.S. patent application Ser. No. 09/594,680 filed herewith and incorporated herein by reference in its entirety.

In the exemplary embodiments shown in FIGS. 2 and 3, the cap carriage 300 carries two printhead caps 600, each having a separate pinch tube 63. Accordingly, the pinch tube actuation portion 140 includes a first pinch tube actuating cam 142 and a second pinch tube actuation cam 144. The first pinch tube actuating cam 142 actuates a first pinch mechanism to pinch a first pinch tube 63 connected to the first one of the two printhead caps 600. Similarly, the second pinch tube actuating cam 144 actuates a second pinch mechanism to pinch a second pinch tube 63 connected to the second one of the two printhead caps 600.

The cam shaft 100 then continues to rotate in the counterclockwise direction until the cam shaft 100 reaches the extreme counterclockwise position. In particular, in various exemplary embodiments, each of at least one of the cam arms of one of the wiper blade drive portion 120, the cam-actuated lever capping arm drive portion 130 and the pinch tube actuator portion 140 of the cam shaft 100 rigidly contacts a corresponding counterclockwise cam stop formed on one of the wiper blade drive mechanism, the cam-actuated lever capping arm 200 and the punch tube mechanism 140 when the cam shaft 100 reaches the extreme counterclockwise position. This allows the extreme counterclockwise position of the cam shaft 100 to be closely controlled without having to rely on the printer controller 40 precisely stopping the counterclockwise rotation of the cam shaft 100 in response to the signal from the optical relay. In various exemplary embodiments, this counterclockwise cam arm and corresponding cam stop are provided by the hold down cam 132 bearing against the cam-actuated lever capping arm 200. Similarly, in various exemplary embodiments, each of at least one of the cam arms of the cam shaft 100 rigidly contacts a corresponding clockwise cam stop formed on one of the wiper blade drive mechanism, the cam-actuated lever capping arm 200 and the pinch tube mechanism 140 when the cam shaft 100 reaches the extreme clockwise position. This similarly allows the extreme clockwise position of the cam shaft 100 to be closely controlled without having to rely on the printer shaft 100 in response to the signal from the optical relay. In various exemplary embodiments, the clockwise cam arm and corresponding cam stop are provided by the one or more capping cams 134 and the cam-actuated lever capping arm 200. The printer controller 40, based on the signal from the optical relay generated when the optical window 114 is aligned with the optical relay, maintains the cam shaft 100 in the extreme counterclockwise position for one of the predetermined times.

Then, after the predetermined time has elapsed, the printer controller 40 engages the drive motor of the drive gear train to rotate the cam shaft 100 in the clockwise direction. When the cam shaft 100 is rotated in the clockwise direction, the pinch tube actuation portion 140 again interacts with the one or more pinch tubes before the cap carriage 300 is moved from the engaged position to the disengaged position by the cam-actuated lever capping arm drive portion 130, which occurs before the wiper blade drive portion 120 moves the wiper blade platform from the second position to the first position.

In various exemplary embodiments, the sensor wheel 112 is positioned relative to the cap carriage 300 and the printhead caps 600 such that the chances any ink from the one or more printheads 12 will negatively affect the operation of the sensor wheel and the optical relay is reduced. In various exemplary embodiments, the sensor wheel 112 is located on an outside of the maintenance station 1000. While the various mechanisms driven by the cam shaft 100 are located on an interior of the maintenance station 1000.

In various exemplary embodiments, the cam shaft 100 is molded as a single piece. In various exemplary embodiments, the single piece cam shaft 100 molded using any acetyle homopolymer or copolymer with 20% glass fibers and 15% PTFE, i.e., J-80/20/TF/15.

In various exemplary embodiments, the wiper blade driving portion 120, the cam-actuated lever capping arm portion 130 and the pinch tube actuator portion 140 are distributed around the circumference of the cam shaft 100 such that each such portion has a sufficient dwell time that any timing errors do not substantially, or in the limit, do not at all negatively affect the operation of the various mechanisms in, and functions provided by the maintenance station 1000.

While this invention has been described with specific embodiments thereof, it is evident that many alternatives, modifications, and variations will be apparent to those skilled in the art. Accordingly, the preferred embodiments of the invention as set forth herein are intended to be illustrative, not limiting. Various changes may be made without departing from the spirit and scope of the invention.

What is claimed is:

1. A timing and drive system of a maintenance station of an ink jet printer, the ink jet printer having at least one printhead, comprising:

a unitary cam shaft, the cam shaft having an operational range of a full rotation in both a clockwise and counterclockwise direction of the shaft; and a plurality of cam-actuated mechanisms provided in the maintenance station, the cam shaft comprising a plurality of drive portions, including:

a driving and control portion, further including a gear train engaged with a main drive gear;

a rollingly engageable wiper blade drive portion, further including a forward wiper blade driving cam and a reverse wiper blade driving cam;

a cam-actuated rollingly engageable lever capping arm drive portion, further including a hold-down cam and at least one capping cam that interacts with a cam-actuated lever capping arm to move a cap carriage;

a rollingly engageable pinch tube actuating portion, further including a first pinch tube actuating cam and a second pinch tube actuating cam; and wherein each drive portion translating a drive force to each cam-actuated mechanism during both the clockwise and counterclockwise rotations of the cam shaft;

wherein the cam shaft sequentially activates each of the plurality of cam-actuated mechanisms.

2. The timing and drive system of claim 1, wherein the unitary cam shaft is movable through a plurality of counterclockwise subranges and a plurality of clockwise subranges.

3. The timing and drive system of claim 2, wherein the plurality of counterclockwise subranges, comprises:

a first subrange to activate at least one wiper blade mechanism;

a second subrange beyond the first subrange, to activate a capping mechanism;

a third subrange beyond the second subrange, to activate at least one pinch tube mechanism; and a fourth subrange beyond the third subrange, at an extreme counterclockwise position.

4. The timing and drive system of claim 3, and coordinating at least one of the following: at least one hold-down cam for a capping arm; at least one cam stop for the extreme counterclockwise and extreme clockwise position; a sensor wheel formed radially around the cam shaft having an optical window formed in the sensor wheel for positional measurement; and at least one engageable drive gear.

5. The timing and drive system of claim 2, wherein the plurality of clockwise subranges, comprises:

a first subrange to activate at least one pinch tube mechanism;

a second subrange beyond the first subrange, to activate a capping mechanism;

a third subrange beyond the second subrange, to activate at least one wiper blade mechanism; and a fourth subrange beyond the third subrange, at an extreme clockwise position.

6. The timing and drive system of claim 5, and coordinating at least one of the following: at least one hold-down cam for a capping arm; at least one cam stop for the extreme counterclockwise and extreme clockwise position; a sensor wheel formed radially around the cam shaft having an optical window formed in the sensor wheel for positional measurement; and at least one engageable drive gear.

7. The timing and drive system of claim 2, wherein the unitary cam shaft is movable through a plurality of counterclockwise subranges and a plurality of clockwise subranges, comprising:

counterclockwise subranges, including:

a first counterclockwise subrange to activate at least one wiper blade mechanism;

a second counterclockwise subrange beyond the first counterclockwise subrange, to activate a capping mechanism;

a third counterclockwise subrange beyond the second counterclockwise subrange, to activate at least one pinch tube mechanism; and a fourth counterclockwise subrange beyond the third counterclockwise subrange, at an extreme counterclockwise position; and clockwise subranges, including:

a first clockwise subrange to activate at least one pinch tube mechanism;

a second clockwise subrange beyond the first clockwise subrange, to activate a capping mechanism;

a third clockwise subrange beyond the second clockwise subrange, to activate at least one wiper blade mechanism; and a fourth clockwise subrange beyond the third clockwise subrange, at an extreme clockwise position.

8. The timing and drive system of claim 7, and coordinating at least one of the following: at least one hold-down cam for a capping arm; at least one cam stop for the extreme counterclockwise and extreme clockwise position; a sensor wheel formed radially around the cam shaft having an optical window formed in the sensor wheel for positional measurement; and at least one engageable drive gear.

9. The timing and drive system of claim 8, wherein the sensor wheel having an optical window, is located on an end portion of the unitary cam shaft to avoid any ink discharge.

10. The timing and drive system of claim 8, wherein the cam shaft is molded as a single piece.

11. The timing and drive system of claim 10, wherein the single piece cam shaft is molded using any acetyle homoploymer or copolymer with 20% glass fibers and 15% PTFE.

12. The timing and drive system of claim 1, wherein the cam shaft is molded as a single piece.

13. The timing and drive system of claim 12, wherein the single piece cam shaft is molded using any acetyle homoploymer or copolymer with 20% glass fibers and 15% PTFE.

14. A method for manufacturing a maintenance station for an ink jet printer system, having a unitary cam shaft, comprising:

forming the unitary cam shaft and a vertical frame member of a rigid plastic material;

inserting into preformed circular openings formed in the frame the end portions of the unitary cam shaft; and placing the unitary cam shaft into the maintenance station for each of a plurality of drive portions, including:

a driving and control portion, further including a gear train engaged with a main drive gear;

a rollingly engageable wiper blade drive portion, further including a forward wiper blade driving cam and a reverse wiper blade driving cam;

a cam-actuated rollingly engageable lever capping arm drive portion, further including a hold-down cam and at least one capping cam that interacts with a cam-actuated lever capping arm to move a cap carriage;

a rollingly engageable pinch tube actuating portion, further including a first pinch tube actuating cam and a second pinch tube actuating cam; and located upon the unitary cam shaft, to engageably actuate each of plurality of cam-actuated mechanisms.

15. The method of claim 14, wherein inserting the unitary cam shaft into the performed circular openings formed in the frame, further comprises snap-inserting each end portion of the unitary cam shaft into the circular openings formed in the frame.

16. A method of timing and driving a maintenance station of an ink jet printer, the ink jet printer having at least one printhead, comprising:

operating a unitary cam shaft having an operational range of a full rotation in both a clockwise and counterclockwise direction, the unitary cam shaft being movable through a plurality of counterclockwise subranges and a plurality of clockwise subranges;

driving a plurality of cam-actuated mechanisms provided in the maintenance station with the unitary cam shaft, the cam shaft comprising a plurality of drive portions; and translating a drive force to each drive portion for each cam-actuated mechanism during both the clockwise and counterclockwise rotations of the unitary cam shaft, wherein the unitary cam shaft sequentially activates each of the cam-actuated mechanisms and wherein the plurality of counterclockwise subranges, comprise:

moving through a first subrange to activate at least one wiper blade mechanism;

moving through a second subrange beyond the first subrange, to activate a capping mechanism;

moving through a third subrange beyond the second subrange, to activate at least one pinch tube mechanism; and moving through a fourth subrange beyond the third subrange, at an extreme counterclockwise position.

17. The method of claim 16, wherein the operating step further includes at least one of the following: coordinating at least one hold-down cam for a capping arm; coordinating at least one cam stop for the extreme counterclockwise and extreme clockwise position; coordinating a sensor wheel formed radially around the cam shaft having an optical window formed in the sensor wheel for positional measurement; and coordinating at least one engageable drive gear.

18. A method of timing and driving a maintenance station of an ink jet printer, the ink jet printer having at least one printhead, comprising:

operating a unitary cam shaft having an operational range of a full rotation in both a clockwise and counterclockwise direction, the unitary cam shaft being movable through a plurality of counterclockwise subranges and a plurality of clockwise subranges;

driving a plurality of cam-actuated mechanisms provided in the maintenance station with the unitary cam shaft, the cam shaft comprising a plurality of drive portions; and translating a drive force to each drive portion for each cam-actuated mechanism during both the clockwise and counterclockwise rotations of the unitary cam shaft, wherein the unitary cam shaft sequentially activates each of the cam-actuated mechanisms and wherein the plurality of clockwise subranges, comprise:

moving through a first subrange to activate at least one pinch tube mechanism;

moving through a second subrange beyond the first subrange, to activate a capping mechanism;

moving through a third subrange beyond the second subrange, to activate at least one wiper blade mechanism; and moving through a fourth subrange beyond the third subrange, at an extreme clockwise position.

19. The method of claim 18, wherein the operating step further includes at least one of the following: coordinating at least one hold-down cam for a capping arm; coordinating at least one cam stop for the extreme counterclockwise and extreme clockwise position; coordinating a sensor wheel formed radially around the cam shaft having an optical window formed in the sensor wheel for positional measurement; and coordinating at least one engageable drive gear.

20. A method of timing and driving a maintenance station of an ink jet printer, the ink jet printer having at least one printhead, comprising:

operating a unitary cam shaft having an operational range of a full rotation in both a clockwise and counterclockwise direction, the unitary cam shaft being movable through a plurality of counterclockwise subranges and a plurality of clockwise subranges;

driving a plurality of cam-actuated mechanisms provided in the maintenance station with the unitary cam shaft, the cam shaft comprising a plurality of drive portions; and translating a drive force to each drive portion for each cam-actuated mechanism during both the clockwise and counterclockwise rotations of the unitary cam shaft, wherein the unitary cam shaft sequentially activates each of the cam-actuated mechanisms and wherein the counterclockwise subranges, include:

moving through a first counterclockwise subrange to activate at least one wiper blade mechanism;

moving through a second counterclockwise subrange beyond the first counterclockwise subrange, to activate a capping mechanism;

moving through a third counterclockwise subrange beyond the second counterclockwise subrange, to activate at least one pinch tube mechanism; and moving through a fourth counterclockwise subrange beyond the third counterclockwise subrange, at an extreme counterclockwise position; and the clockwise subranges, include:

moving through a first clockwise subrange to activate at least one pinch tube mechanism;

moving through a second clockwise subrange beyond the first clockwise subrange, to activate a capping mechanism;

moving through a third clockwise subrange beyond the second clockwise subrange, to activate at least one wiper blade mechanism; and moving through a fourth clockwise subrange beyond the third clockwise subrange, at an extreme clockwise position.

21. The method of claim 20, wherein the operating step further includes at least one of the following: coordinating at least one hold-down cam for a capping arm; coordinating at least one cam stop for the extreme counterclockwise and extreme clockwise position; coordinating a sensor wheel formed radially around the cam shaft having an optical window formed in the sensor wheel for positional measurement; and coordinating at least one engageable drive gear.

* * * * *